US005507623A

United States Patent [19]

Kojima et al.

[11] Patent Number: 5,507,623

[45] Date of Patent: Apr. 16, 1996

[54] ALLOY-COATED GAS TURBINE BLADE AND MANUFACTURING METHOD THEREOF

[75] Inventors: Yoshitaka Kojima, Hitachi; Kiyoshi Otake, Takahagi; Akira Mebata, Kitaibaraki; Hideyuki Arikawa, Hitachi; Tetsuo Sasada, Hitachi; Hajime Toriya, Hitachi, all of Japan

[73] Assignee: Hitachi, Ltd., Tokyo, Japan

[21] Appl. No.: 286,787

[22] Filed: Apr. 4, 1994

Related U.S. Application Data

[63] Continuation of Ser. No. 947,564, Sep. 21, 1992, abandoned.

[30] Foreign Application Priority Data

Sep. 20, 1991 [JP] Japan ..... 3-241843

[51] Int. Cl.[6] ..... F01D 5/28

[52] U.S. Cl. ..... 416/241; 427/456; 428/610; 428/652; 428/680

[58] Field of Search ..... 416/241 R, 229 A; 427/456; 428/610, 652, 680, 937

[56] References Cited

U.S. PATENT DOCUMENTS

| | | | |
|---|---|---|---|
| 4,080,486 | 3/1978 | Walker et al. . | |
| 4,101,715 | 7/1978 | Rairden | 427/456 |
| 4,123,594 | 10/1978 | Chang | 428/652 |
| 4,145,481 | 3/1979 | Gupta et al. | 427/456 |
| 4,198,442 | 4/1980 | Gupta et al. | 427/456 |
| 4,246,323 | 1/1981 | Bornstein et al. . | |
| 4,326,011 | 4/1982 | Goebel et al. . | |
| 4,446,199 | 5/1984 | Gedwill et al. | 416/241 R |
| 4,481,237 | 11/1984 | Bosshart et al. | 428/610 |
| 4,933,239 | 6/1990 | Olson et al. | 427/456 |
| 5,034,284 | 7/1991 | Bornstein et al. | 416/241 R |
| 5,064,510 | 11/1991 | Thoma et al. | 205/228 |
| 5,077,140 | 12/1991 | Luthra et al. | 428/660 |

*Primary Examiner*—Edward K. Look
*Assistant Examiner*—James A. Larson
*Attorney, Agent, or Firm*—Antonelli, Terry, Stout & Kraus

[57] ABSTRACT

A coated layer of this invention is composed of a lower alloy-coated layer 2 formed of an MCrAlY alloy whose principal element is Co or Co and Ni, an upper alloy-coated layer 1 formed of an MCrAlY alloy whose principal element is Ni and a portion 4 in which an Al content of the surface portion of the upper coated layer 1 is largest and is reduced gradually towards a more internal part. Manufacturing thereof involves the steps of forming the lower and upper coated layers and effecting an Al diffusion treatment into the upper coated layer. The upper coated layer having the portion which exhibits the large Al content contributes to a high-temperature anticorrosive property. A gas turbine blade is provided with the alloy-coated layer, wherein the lower coated layer incorporates a composite function to prevent a high-temperature corrosion of a base material when cracks are caused in the upper coated layer due to thermal stress. The gas turbine blade exhibits effects of improving the reliability and increasing a life-time.

15 Claims, 9 Drawing Sheets

ALLOY-COATED GAS TURBINE BLADE AND MANUFACTURING METHOD THEREOF

This application is a Continuation application of application Ser. No. 947,564, filed Sep. 21, 1992, abandoned.

BACKGROUND OF THE INVENTION

1. Field of the Invention

The present invention relates an alloy-coated gas turbine blade exhibiting a high-temperature durability and especially a high-temperature anticorrosive property, a manufacturing method thereof and a gas turbine including the same gas turbine blade.

2. Related Background Art

A gas turbine for power generation aims at improving a power generation efficiency, and a temperature of a combustion gas is therefore increased. As a result, it is highly demanded that a high-temperature durability of turbine stationary and moving blades exposed to a high-temperature combustion gas be improved. Required is a high-temperature durability, particularly the durability against the high-temperature corrosion induced by S in a fuel and Na, K or the like in the air for combustion. As a measure for preventing such a high-temperature corrosion, a method of coating alloy exhibiting an excellent high-temperature anticorrosive property is typically put into practice.

Further, as a matter of course, a metal temperature of the blade base material increases concomitantly with a rise in temperature of the combustion gas. There is, however, a limit in terms of a strength of a heat resistant material against the high temperature. Hence, a technology of cooling the blade remarkably advances. Consequently, the blade is constructed of a heat resistant alloy which assumes a hollowed structure and is small in wall thickness. The reduction in wall thickness of the blade because of the high-temperature corrosion remarkably spoils a high-temperature reliability of the blade.

Besides, a method of cooling the blade involves the use of a return flow, impingement, etc., thereby decreasing the metal temperature of the blade base material. However, the complicated cooling method is employed, and hence the uniform cooling over the blade becomes difficult. A distribution of temperatures is often produced.

Under such circumstances,a variety of anticorrosive coating materials and coating methods are proposed. The following is the method which has been used most frequently. Cr and Al are added to Co or Ni and an alloy of a combination thereof. Further, the blade is coated with an alloy to which Y and other rare earth elements are added (hereinafter referred to as an MCrAlX alloy. M implies Fe, Ni and Co, while X implies Y and other rare earth elements.) In the turbine blade coated with such an MCrAlX alloy, if under a high-temperature corrosion environment, the oxidation reaction of Cr, Al precedes the sulfidization reaction of Ni or Co, with the result that oxides of Cr, Al are produced. A sulfide of Ni or Co is a compound having a low melting point and easily assumes a liquid phase. Then, the reaction is promoted, and the wall is largely reduced.

On the other hand, the oxides of Cr, Al have a high melting point but do not assume the liquid phase. Therefore, the oxide is faster in formation reactive speed than the sulfide, and the degree of wall-reduction is reduced. Namely, MCrAlX alloy coating has greater Cr and Al contents than the heat resistant alloy. The oxidation of Cr, Al under the high-temperature corrosion environment is caused, and the high-temperature anticorrosive property is excellent with a less wall-reduction.

Further, as a result of this, the alloys containing much Cr, Al are required for MCrAlX alloy coating which exhibits more excellent high-temperature anticorrosive property. However, if the contents of Cr, Al increase for MCrAlX alloy coating, a toughness of alloy coating declines, thereby easily causing damages such as cracks or the like. If cracks are caused in the coated layer, the damage originating from the cracks advances to the blade base material, whereby the blade constructed thin is broken down.

In order to correspond to the deterioration of the high-temperature corrosion environment condition concomitant with the rise in the combustion gas temperature and the changes in the blade structure, a variety of improvements have been proposed as compared with the turbine blades having a low combustion gas temperature (in this case, no cooling is effected, or the cooling structure is simple, while the blade wall thickness is large). In techniques disclosed in, e.g., U.S. Pat. No. 4,080,486, U.S. Pat. No. 4,246,323 and U.S. Pat. No. 4,326,011, the contents of Al, Cr and Si in the vicinities of the surface portions of MCrAlX alloy coatings are increased. These methods depend chiefly on diffusive permeation. Proposed according to those methods is that the high-temperature anticorrosive property of MCrAlX alloy coating can be ameliorated by forming surface layers containing much Al, Cr and Si.

Further, the contents of Al, Cr, Si of the lower portion of the alloy coating are less than in the vicinity of the surface portion. There is no decline of toughness in the lower portion, and it is therefore predicted that if the cracks are produced in the surface portion, the advancement thereof stops at the lower portion.

However, any of those known improved techniques about the anticorrosive property of MCrAlZ alloy coating has attained reforming of only the surface portion of MCrAlX alloy coating of a single composition. As a result of examination by the present inventors, it have proven that those gas turbine blades are not necessarily sufficient for the combustion gas temperature.

SUMMARY OF THE INVENTION

It is a general object of the present invention to provide a gas turbine blade exhibiting an excellent durability against high temperatures, a manufacturing method thereof and further a gas turbine including the same gas turbine blade on the basis of the results of examining the known techniques about MCrAlX alloy coating.

According to the present invention, there have been performed high-temperature corrosion tests about a variety of MCrAlX alloy-coated layers and coated layers containing much Al, Cr of the surface portions thereof. It has been found out that the turbine blade becomes superlative by providing multi-coated layers having various purposes and actions as anticorrosive coated layers for a high-temperature gas turbine under a high combustion gas temperature.

Attention is paid to Al defined as an effective element in terms of preventing the high-temperature corrosion in the MCrAlX alloy-coated layer. The following knowledge is obtained from an execution of a high-temperature corrosion test by increasing the Al contents of the surface portions of the MCrAlX alloy-coated layers of various compositions. Namely, it can be confirmed that where M of the MCrAlX alloy-coated layer is Co and Ni containing Co, the coated layer having an increased Al content of the surface portion is lower in the high-temperature anticorrosive property than the coated layer with no increment of the Al content.

On the other hand, where M of the MCrAlX alloy-coated layer is Ni, the anticorrosive property is remarkably improved by augmenting the Al content of the surface portion as compared with the case where the Al content is not increased.

While on the other hand, in the comparative results about the anticorrosive property according to types of M of the MCrAlX alloy-coated layers, the coated layers in which M is Co or Co-Ni exhibit a good anticorrosive property. Whereas in such a case that M is Ni, the anticorrosive property is considerably low.

In comparisons between those results, under the same testing conditions, the coated layers are sequenced as follows: (1) the coated layer having an increased Al content of the surface of the MCrAlX alloy-coated layer M is Ni, (2) the MCrAlX alloy-coated layer where M is Co or Co—Ni, (3) the coated layer having an increased Al content of the surface of the MCrAlX alloy-coated layer in which M is Co or Co—Ni is increased, and (4) the MCrAlZ alloy-coated layer in which M is Ni. From 3-element state diagrams of Ni—Cr—Al and Co—Cr—Al, a thinkable reason for such results is as below. A solid solution limit of phase (CoAl) in α phase (Co) which becomes a matrix is small in a Co—Cr—Al system, and the β phase is readily educed with an increment of Al. Whereas in an Ni—Cr—Al system, the solid solution limit of the β phase (NiAl) in γ phase (Ni) which becomes the matrix is large, and it is hard to reduce the β phase with the increment of Al.

More specifically, in the MCrAlX alloy-coated layer where M is Co or Co—Ni, a good deal of β phase is reduced by augmenting the Al content of the surface portion. The educed phases thereof are aggregated into a bigger one. On the other hand, in the MCrAlX alloy-coated layer where M is Ni, it is difficult to educe the β phase even by augmenting the Al content of the surface portion. Even if reduced, there is no growth extending to a large reduced phase because of a small quantity thereof.

From the above-described difference, it is presumed that the high-temperature anticorrosive property differs due to the states of the educed phases and a difference in the Al content between the portions which become the matrices. Namely, the increment in the Al content of the surface portion presents a big problem in terms of improving the anticorrosive property in the MCrAlX alloy-coated layer where M is Co or Co—Ni. On the other hand, when increasing the Al content of the surface portion in an MCrAlY alloy-coated layer where M is Ni, the Al content in the matrix augments, and the reduced phase is small. The coated layer therefore exhibits the most excellent anticorrosive property. The toughness of the portion having the increased Al content is, however, reduced. As a result, cracks are caused in the coated layer where the toughness declines due to the thermal stress when starting and stopping the gas turbine particularly in an intricate thin-wall air cooling blade for use with the high-temperature gas turbine. The high-temperature corrosion advances to a lower layer via the cracks described above. Therefore, in a NiCrAlX alloy-coated layer where the Al content of the surface portion increases, the anticorrosive property of the lower alloy-coated layer having the incremented Al content is also an important factor.

Accordingly, on the basis of the above-described results of examinations according to the present invention, as a coated layer having the excellent high-temperature anticorrosive property and high-temperature reliability for a thin-wall hollow-structured complicated cooling blade for a high temperature gas turbine under severe high-temperature corrosive conditions and large thermal stress, there is found out a coated layer constructed such that an MCrAlX alloy-coated layer whose principal element is Co or Co—Ni is provided on a portion which contacts a blade base material; an MCrAlX alloy-coated layer whose principal element is Ni is provided thereon; and an Al content of the MCrAlX alloy-coated layer whose principal element is Ni is large in the outermost surface portion but continuously decreases towards a more internal part.

Namely, according to one aspect of the present invention, there is provided a gas turbine blade having a coated layer provided on the surface of a base material made of a heat resistant alloy and exhibiting an opulent high-temperature anticorrosive property and oxidation resistant property, the coated layer including two layers, i.e., a Co based lower alloy-coated layer containing Cr, Al and consisting of any one of or a combination of Y and/or Ta, Zr, Ce or with respect to a portion which contacts the base material and a Ni based upper alloy-coated layer containing Cr, Al and consisting of any one or a combination of Y and/or Ta, Zr, Ce, wherein an Al content of the upper alloy-coated layer increases in the outermost surface and is diffused while being continuously reduced on the internal side.

According to another aspect of the present invention, there is provided a gas turbine blade having a coated layer provided on the surface of a base material made of a heat resistant alloy and exhibiting an opulent high-temperature anticorrosive property and oxidation resistant property, the coated layer including two layers, i.e., a Co—Ni based lower alloy-coated layer containing Cr, Al and consisting of any one of or a combination of Y and/or Ta, Zr, Ce or with respect to a portion which contacts the base material and a Ni based upper alloy-coated layer containing Cr, Al and consisting of any one or a combination of Y and/or Ta, Zr, Ce, wherein an Al content of the upper alloy-coated layer increases in the outermost surface and is diffused while being continuously reduced on the internal side.

In the alloy-coated gas turbine blade, the lower alloy-coated layer consists preferably of Cr: 10–30 wt %, Al: 5–15 wt %, Y: 0.1–1.5 wt %, remaining Co and inevitable impurities, and the upper alloy-coated layer consists of Cr: 10–30 wt %, Al: 5–15 wt %, Y: 0.1–1.5 wt %, the remaining being Ni and the inevitable impurities. Alternatively, the lower alloy-coated layer consists preferably of Cr: 10–30 wt %, Al: 5–15 wt %, Y: 0.1–1.5 wt %, the remaining being Co—Ni; the Co/Ni ratio of which is 0.5 or above and inevitable impurities, and the upper alloy-coated layer consists preferably of Cr: 10–30 wt %, Al: 5– 15 wt %, Y: 0.1–1.5 wt %, the remaining being Ni and the inevitable impurities. Further, a maximum concentration of Al diffused in the upper alloy-coated layer is preferably 15–25% by weight. Al diffused in the upper alloy-coated layer is preferably reduced continuously from the outermost surface to the portion which contacts the lower alloy-coated layer; or Al is preferably reduced gradually from the outermost surface and comes to a substantially constant value at a portion on this side just before contacting the lower alloy-coated layer. The lower alloy-coated layer is preferably 25–200 μm thick, and the upper alloy-coated layer is preferably 25–200 μm thick.

At the blade tip part, preferably there is no alloy coating layer and Al is diffused into the substrate or base metal. The blade tip part has a highly complicated configuration so that it is extremely difficult to form an alloy coating film at this portion of the blade. In addition, the substrate temperature is lower at the blade tip part than at the other portions of the blade because the blade tip part is cooled by the cooling gas. It is, therefore, not necessary to provide an alloy coating layer on this part of the blade.

Furthermore, in the alloy-coated gas turbine blade, the two alloy-coated layers wherein Al is diffused into an upper layer of the two alloy-coated layers are provided preferably on at least an entire blade surface and a platform. Herein, Al is more preferably diffused in the base material surface of a blade tip part to increase an Al content in the vicinity of the base material surface rather than providing the two-alloy coated layers at the tip. Additionally, the two alloy-coated layers into which Al is diffused into the upper layer only are provided preferably on at least the entire blade surface and the surface of a gas-pass portion exposed to a combustion gas.

According to still another aspect of the present invention, there is provided a method of manufacturing an alloy-coated gas turbine blade having a coated layer provided on the surface of a base material made of a heat resistant allay and exhibiting an opulent high-temperature anticorrosive property and oxidation resistant property, the method comprising the steps of: forming, on a base material surface, a lower alloy-coated layer a principal element of which is Co or Co—Ni, the layer containing Cr, Al and further consisting of any one or a combination of Y and/or Ta, Zr, Ce; forming a Ni based alloy-coated layer containing Cr, Al and further consisting of Y and a rare earth element on the surface of the lower alloy-coated layer; forming a Ni based upper alloy-coated layer containing Cr, Al and further consisting of any one or a combination of Y and/or Ta, Zr, Ce; and permeating Al diffusively into the upper alloy-coated layer.

According to a further aspect of the present invention, there is provided a gas turbine comprising: a compressor; a combustor; a single-staged or plural-staged turbine blade in which a dovetail portion is fixed to a turbine disk; and a turbine nozzle provided corresponding to the blade, characterized by further comprising any of the alloy-coated gas turbine blades described above.

In the turbine blade provided with the coated layers according to the present invention, the upper alloy-coated layer is composed of the MCrAlX alloy whose principal element is Ni, wherein the Al content is large at the outermost surface portion and is continuously reduced towards the internal part. The upper alloy-coated layer exhibits the action to protect the turbine blade from a severe high-temperature corrosion environment. The continuous changes in the Al content make it difficult to cause damages such as cracks or the like in the Ni based MCrAlX alloy-coated layer due to the thermal stress of the blade base material that is produced in the thin-wall structured air cooling turbine blade. In the MCrAlY alloy-coated layer where the Al content is augmented, the toughness is deteriorated with the increment of the Al content. Hence, when the portions having large and small Al contents are discontinuous, especially when the Al content abruptly varies, the cracks are easily caused in the portion having the increased Al content due to the thermal stress.

However, in the turbine blade exposed to the high combustion gas temperature, the cracks readily occur in the coated layer even in the turbine blade provided with the above-mentioned coated layer during repetitions of starting and stopping of the turbine while producing the thermal stress.

In this connection, the present invention has such a structure that the lower alloy-coated layer composed of the Co based or Co—Ni based MCrAlX alloy-coated layer exhibiting a more excellent high-temperature anticorrosive property than the Ni based MCrAlX alloy-coated layer is provided between the above-mentioned coated layer and the base material. Herein, the Co or Co—Ni based MCrAlX alloy-coated layer has the more superlative high-temperature anticorrosive property than the Ni based MCrAlX alloy-coated layer from the results of the test where the high-temperature corrosion is simulated.

Therefore, in the gas turbine blade provided with the coated layer having the structure according to the present invention, even if the cracks are produced in the Ni based MCrAlX alloy-coated layer having the increased Al content and exhibiting the excellent high-temperature anticorrosive property but a problem in terms of toughness due to the thermal stress induced by the start and stop of the gas turbine, the Co based or Co—Ni based MCrAlX alloy-coated layer showing a more excellent high-temperature anticorrosive property than the Ni based MCrAlX alloy-coated layer exists thereunder. Based on this structure, the turbine blade has a higher reliability against the high-temperature corrosion than the gas turbine blade provided with the known coated layer (e.g., U.S. Pat. No. 4,080,486).

In addition, another aspect of the present invention is a method of manufacturing an alloy-coated gas turbine blade having a coated layer provided on the surface of a base material made of a heat resistant alloy and exhibiting an opulent high-temperature anticorrosive property and oxidation resistant property, said method comprising the steps of:

forming, on a base material surface, a lower alloy-coated layer a principal element of which is any one of Co and Co—Ni alloy, said layer containing Cr, Al and one member selected from the following group;

forming a Ni based upper alloy-coated layer containing Cr, Al, and one member selected from the following group on the surface of said lower alloy-coated layer; and permeating Al diffusively into said upper alloy-coated layer; said group consisting of:

(1) Y;

(2) any one of Ta, Zr and Ce;

(3) any two or more elements of Ta, Zr and Ce;

(4) Y and any one of Ta, Zr and Ce; or (5) Y and any two or more elements of Ta, Zr an Ce.

As described above, the present invention is characterized by providing the gas turbine blade and the gas turbine including the same the gas turbine blade provided with the coated layers capable of presenting the high-temperature anticorrosive property enough to correspond to low grade fuels that should be considered in terms of improving the reliability of the blade (taking a hollow and thin-wall structure to decrease the metal temperature of the blade base material) for use with the gas turbine under a high combustion gas temperature and further taking sufficient measures for the cracks in the coated layer due to the thermal stress caused during the start and stop.

The following is an explanation about compositions of elements of the CoCrAly or CoNiCrAlY alloy-coated layer and those of the NiCrAlY alloy provided thereon.

The respective elements of Cr, Al serve to maintain the high-temperature anticorrosive property. The anticorrosive property declines when Cr is 10 wt % or under; and Al is 5 wt % or under. Further, when Cr is 30 wt % or above; and Al is 15 wt % or larger, an educed quantity of β phase of inter-metal compounds NiAl, CoAl or the like becomes large, whereas the toughness is reduced. Cr serves to promote educing of β phase. The action with respect to Y is the same as above. Especially in the case of 1.5 wt % or greater, $Y_2O_3$ is educed in a granular field, and the toughness is deteriorated. In the case of CoCrAlY alloy coating, Ni is contained as an impurity. Further, in the case of CoNiCrAlY alloy coating, when a Co/Ni ratio is 0.5 or smaller, Ni is a large proportion of alloy composition, and the anticorrosive property declines. In the case of NiCrAlY alloy coating, Co is contained as an impurity.

Note that the high-temperature anticorrosive property is improved by adding a total quantity 5 wt % or less with such a construction that each alloy-coated layer is based on Y as an element and includes, as other element, any one of Ta, Zr, Ce and a combination thereof.

The Al content diffused in the upper coated layer will be explained. An effective value of the maximum Al concentration in the Al diffused layer falls within a range of 15–25%. An effect of the Al diffusion does not appear at 10%, and the anticorrosive property is poor. The educed quantity of NiAl increases at 30%, and the anticorrosive property is still poor. There is not so much educed quantity of NiAl at 15–25%, and there is exhibited the effect of a higher concentration of Al of the surface portion of the coated layer undergoing the high-temperature corrosion. The anticorrosive property of the coated layer can be ameliorated particularly under a high-temperature condition (90° C. or above)

The base material of the gas turbine moving blade involve the use of Ni-radical alloy castings having an element composition in wt % such as C: 0.1–0.2%, Co: 8–11%, Ni: 55% or above. The base material may contain other elements, i.e., one or more elements of less than 5% Ta, Mo, Nb, Hf, Zr and Re.

The base material of the gas turbine stationary blade involves the use of Co-radical casting alloys having element compositions in wt % such as C: 0.2–0.5%, Ni: 5– 15%, Si: 2 5 or less, Mn: 2% or under, Cr: 25–35%, W: 3–10%, B: 0.003–0.03%, Co: 45% or above. The base material may contain other elements, viz., one or more elements of less than 1% Ti, Nb, Hf and Ta.

BRIEF DESCRIPTION OF THE DRAWINGS

Other objects and advantages of the present invention will become apparent during the following discussion taken in conjunction with the accompanying drawings, in which.

DESCRIPTION OF THE PREFERRED EMBODIMENTS

Embodiment 1

A test specimen is manufacture by coating the surface of an Ni-based heat resistant alloy (Rene'-80 Ni-9.5 wt % Co-14 wt % Cr-3 wt % Al-4 wt % W-4 wt % Mo-5 wt % Ti-O.17 wt % C) with a coated layer according to the present invention, wherein the heat resistant alloy used as a gas turbine blade material serves as a test specimen base material. The test specimen assumes such a configuration and dimensions that there are employed a round bar of diameter 9×50 mm and a hollow pipe of diameter 9×80 mm, the pipe being hollowed at its center with a bore having a diameter of 5 mm. To start with, the test specimen is degreased and washed. Thereafter, the test specimen undergoes a blasting treatment to granulate the surface with the compressed air having a pressure of 5 $Kg/cm^2$ by use of a grid made of $Al_2O_3$ (particle diameter 100–150 μm)

Provided thereafter is a lower alloy-coated layer having a composition of Co-32% Ni-21% Cr-8% Al-1% Y by a plasma spray coating method in a depressurized atmosphere. A thickness thereof is 75 μm. The following are conditions for forming the lower alloy-coated layer: Ar-7% $H_2$ plasma is used; a plasma output is 50 KW; a spray distance is 250 mm; an atmospheric pressure during spraying is 50 Torr; a powder supply quantity is 50 g/min; and a test specimen temperature during spraying is 650° C.

Thereafter, an upper alloy-coated layer composed of an alloy of Ni-20% Cr-8% Al-0.5% Y is provided on the lower alloy-coated layer of Co—Ni—Cr—Al—Y by the same method. A thickness thereof is 75 μm. Conditions for forming the upper alloy-coated layer are the same as those of the alloy-coated layer of Co Ni Cr Al Y.

In this manner, an Al diffusion treatment is effected by using the test specimen constructed of the coated layers having a double-layered structure including the CoNiCrAlY alloy-coated layer and NiCrAlY alloy-coated layer deposited on the base material surface composed of the Ni-radical heat resistance alloy. Executed is such a treatment as to increase an Al content of the surface of the NiCrAlY alloy-coated layer. The following is a treating method thereof. The test specimen is embedded in mixed powder composed of 4% Al+1.5% $NH_4Cl$–remaining $Al_2O_3$. The test specimen is heated in an Ar atmosphere at 750° C. for 4 hours. Thereafter, the test specimen is taken out of the mixed powder and is subjected to a heating treatment in vacuum at 1060° C. for 4 hours after substances adhered to the surface have been removed.

Figure 1A:
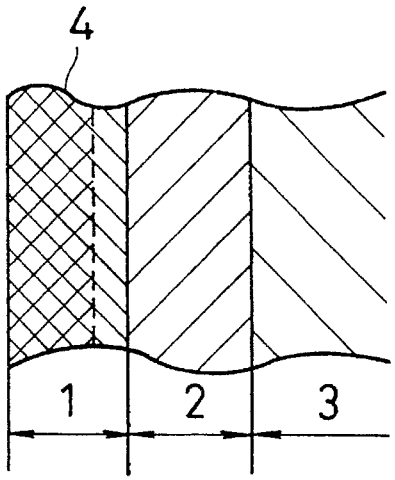
FIG. 1A is a schematic sectional view illustrating a coated layer according to the present invention.
Figure 1B:
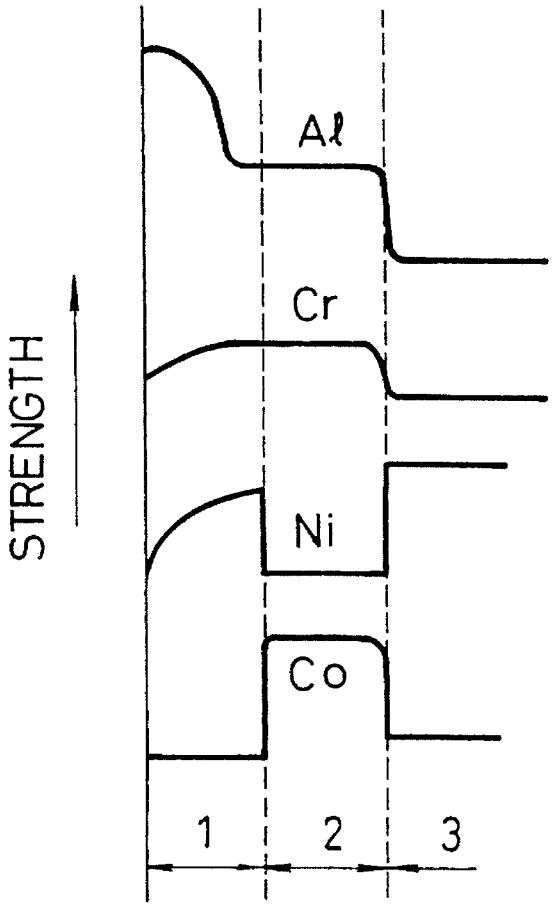
FIG. 1B is a view showing analytic results of Co, Ni, Cr, Al by EPMA.

FIG. 1A is a schematic view showing a result of observing a sectional geometry of the thus manufactured test specimen. FIG. 1B shows an analytic result of Co, Ni, Cr, Al in section by EPMA. The lower alloy-coated layer 2 is provided on the surface of the base material 3, and the upper alloy-coated layer is deposited thereon. In the coated layers based on the double-layered structure according to the present invention, as obvious from FIG. 1, the Al content of the surface of the NiCrAlY upper alloy-coated layer 1 is largest and reduced towards a more internal part. The maximum Al concentration in the Al diffused layer of the present invention which has been manufactured is 15% from the analytic result of EPMA. Note that according to the present invention, the maximum Al concentration in the Al diffused layer is important, and its control is attainable depending on a composition ratio of the mixed powder of Al—$NH_4Cl$—$Al_2O_3$ employed for the treatment, a treating temperature and a treating time.

A method of increasing the Al concentration involves incrementing the Al content in the mixed powder, the treating temperature and the treating time as well. A method of reducing the Al concentration is contrary thereto. In this embodiment, the Al concentration is controlled by the Al content in the mixed powder. Namely, the following treatments are carried out:

- a treatment using mixed powder of 10% Al+1.0% $NH_4Cl$+ remaining $Al_2O_3$ (Treatment No.A);
- a treatment using mixed powder of 15% Al+1.0% $NH_4Cl$+ remaining $Al_2O_3$ (Treatment No.B);
- a treatment using powder of 23% Al+0.5% $NH_4Cl$+ remaining $Al_2O_3$ (Treatment NO.C); and
- a treatment using mixed powder of 2% Al+1.0% $NH_4Cl$+ remaining $Al_2O_3$ (Treatment No.D). In each treatment, the treating temperature is 750° C., and the treating time is 4 hours. As an analytic result of EPMA, the maximum Al concentrations of the Al diffused layer are 20%, 25%, 30% and 10% by using the test specimen under the treating conditions of A, B, C and D. Then, a CoNiCrAlY alloy-coated layer is interposed between the NiCrAlY alloy-coated layer and the base material.

Incidentally, a coated layer of a known example (e.g., U.S. Pat. No. 4,080,486) is also manufactured. The manufacturing method and the conditions thereof are the same as those in forming a part of the coated layer according to the present invention. Employed is alloy powder of Co-20% Cr-8% Al-1% Y or Ni-20% Cr-8% Al-0.5% Y. After forming respective single-composition alloy-coated layers (100 μm in thickness), the Al contents in the surfaces of the coated layers are increased by the same Al diffusion treatment as that for forming a part of the coated layer of this invention.

Figure 2A:
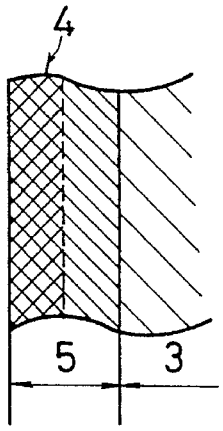
FIG. 2A PRIOR ART
FIG. 2A is a schematic sectional view showing a conventional coated layer.
Figure 2B:
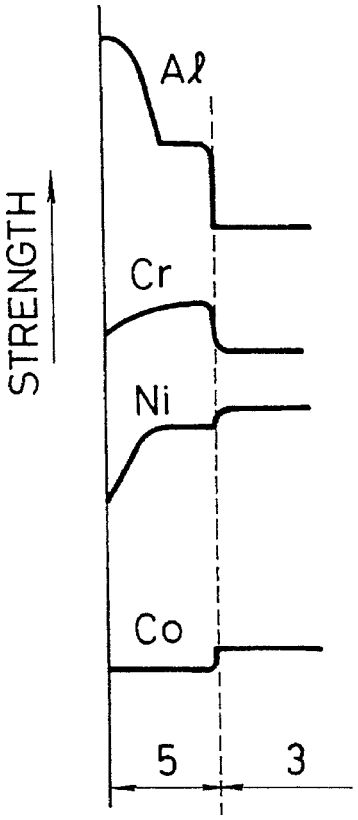
FIG. 2B PRIOR ART
FIG. 2B is a view showing an analytic results of Co, Ni, Cr, Al by EPMA.
Figure 2C:
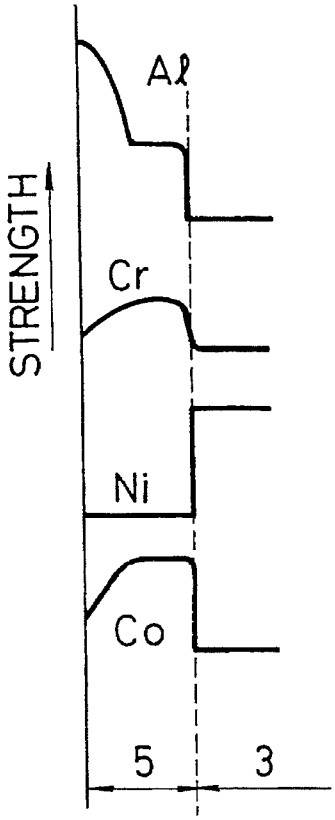
FIG. 2C PRIOR ART
FIG. 2C is a view showing analytic results of Co, Ni, Cr, Al by EPMA.

FIGS. 2A, 2B and 2C are a schematic view showing a result of observing a sectional geometry of the Ni-radical heat resistant alloy provided with a known coated layer described above and views for showing analytic results of Co, Ni, Cr, Al in section by EPMA. Referring to the Figures, the numeral 5 represents an alloy-coated layer composed of a single layer provided on the surface of the base material 3. The maximum Al concentrations of the Al diffused layers which are obtained from the analytic results respectively exhibit values of 15%, 20% and 25%.

Further, as a comparative material, a test specimen formed with MCrAlX alloy-coated layers having various compositions are also manufactured. The comparative material includes a lower coated layer of CoNiCrAlY, an upper coated layer of NiCrAlY and CoCrAlY and a single-composition MCrAlY alloy-coated layer. A manufacturing method thereof is the same plasma spray coating method in the depressurized atmosphere as the method of forming the MCrAlY alloy-coated layer in this embodiment. The spray conditions are the same as those in the embodiment of this invention. A thickness of each coated layer is 75 μm in the double-layered structure but 100 μm in a single-layered structure. Table 1 shows test specimens provided with the coated layer of this invention and a coated layer for a comparison.

TABLE 1

| T.P. No. | Lower Coated Layer (wt %) | Upper Coated Layer (wt %) | Maximum Al Concentration (wt %) of Al Diffused Layer |
|---|---|---|---|
| 1 | Co—32Ni—21Cr—8Al—0.5Y | Ni—20Cr—8Al—0.5Y | 10 |
| 2 | " | " | 15 |
| 3 | " | " | 20 |
| 4 | " | " | 25 |
| 5 | " | " | 30 |
| 6 | — | " | 15 |
| 7 | — | " | 20 |
| 8 | — | " | 25 |
| 9 | Co—32Ni—21Cr—8Al—0.5Y | Ni—10Cr—5Al—0.5Y | — |
| 10 | " | Ni—8Cr—4Al—0.5Y | — |
| 11 | " | Ni—30Cr—15Al—0.5Y | — |
| 12 | " | Ni—35Cr—16Al—0.5Y | — |
| 13 | " | Co—20Cr—8Al—1Y | — |
| 14 | — | Ni—20Cr—11Al—0.5Y | — |
| 15 | — | Ni—30Cr—13Al—0.5Y | — |
| 16 | — | Co—20Cr—11Al—1Y | — |
| 17 | — | Co—30Cr—15Al—1Y | — |
| 18 | — | Co—32Cr—16Al—1Y | — |
| 19 | — | Co—10Cr—5Al—1Y | — |
| 20 | — | Co—8Cr—4Al—1Y | — |
| 21 | — | Co—32Ni—21Cr—8Al—0.5Y | — |
| 22 | — | Ni—30Co—21Cr—8Al—0.5Y | — |
| 23 | — | Ni—24Co—21Cr—8Al—0.5Y | — |
| 24 | — | Ni—20Co—18Cr—10Al—0.5Y | — |
| 25 | | Co—20Cr—8Al—1Y | 15 |
| 26 | | Co—20Cr—8Al—1Y | 20 |
| 27 | | Co—30Cr—15Al—1Y | 25 |

Figure 3:
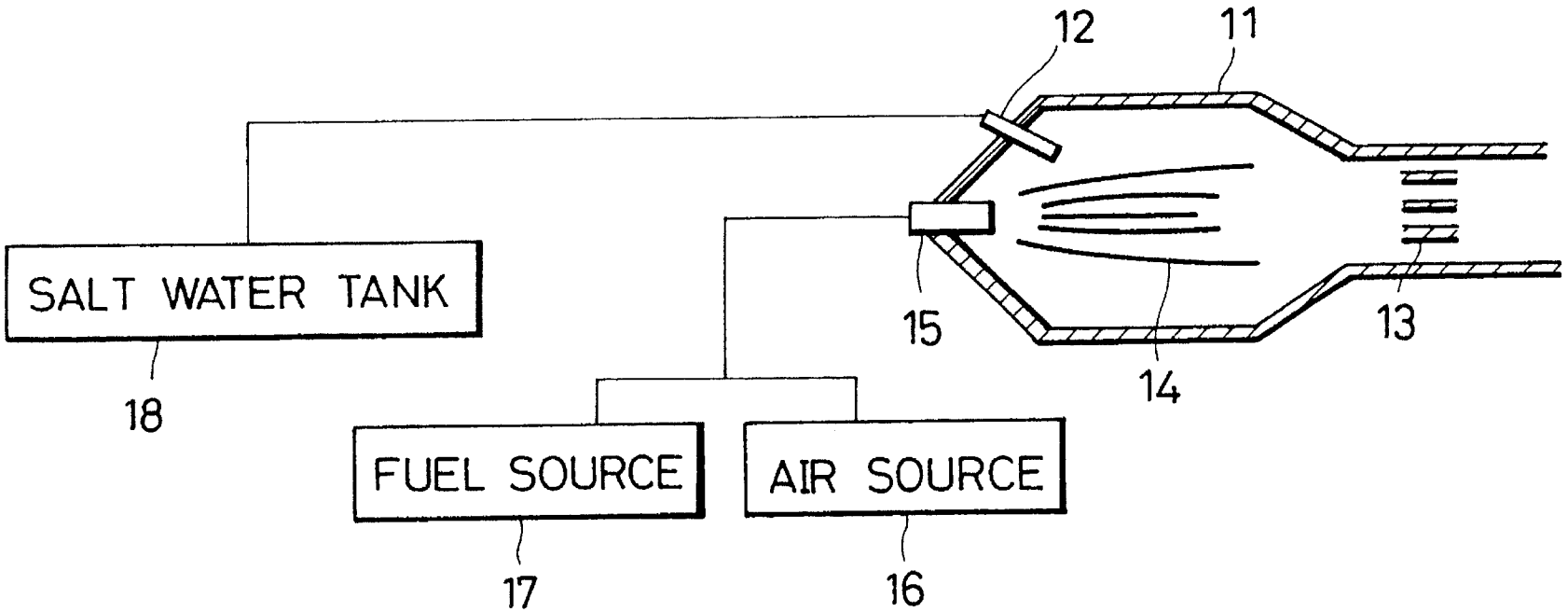
FIG. 3 is a schematic view illustrating a high-temperature corrosion testing device.

A high-temperature anticorrosive of the coated layer is evaluated by a burner rig high-temperature corrosion testing device illustrated in FIG. 3 with the aid of a round bar test specimen provided with these coated layers. In the test, a fuel involves the use of a light oil (S content is 0.4%), and NaCl for causing a high-temperature corrosion is added in a burning flare. As an adding method, a NaCl water solution is thrown into the burning flare, and an added quantity into the burning flare is 200 ppm. The test specimen provided in the burning flare is fitted with a thermocouple for measuring a temperature of the test specimen. After the test, the substances adhered to the test specimen are eliminated. A comparison with a weight measurement value before the test is made, thereby evaluating an amount of loss in weight. Further, if there is no large difference in the weight loss quantity, the sectional geometry of the test specimen is observed to check an existence and non-existence of a damage to the surface of the coated layer. Table 2 shows the results of measuring the weight loss quantities in the high-temperature corrosion test. Table 3 shows the existence and non-existence of the damage to the surface of the coated layer through the observation of the sectional geometry.

TABLE 2

| T.P. No. | Test Temperature (°C.) 850 | 900 | 950 | 1000 |
|---|---|---|---|---|
| 1 | 0 | 0 | −20 | −40 |
| 2 | 0 | 0 | 0 | 0 |
| 3 | 0 | 0 | 0 | 0 |
| 4 | 0 | 0 | 0 | 0 |
| 5 | 0 | −10 | −20 | −40 |
| 6 | 0 | 0 | 0 | 0 |
| 7 | 0 | 0 | 0 | 0 |
| 8 | 0 | 0 | 0 | 0 |
| 9 | 0 | −10 | −30 | −60 |
| 10 | 0 | −20 | −60 | −240 |
| 11 | 0 | −10 | −35 | −70 |
| 12 | −10 | −40 | −85 | −320 |
| 13 | 0 | −15 | −40 | −60 |
| 14 | 0 | −40 | −65 | −200 |
| 15 | 0 | −10 | −20 | −80 |
| 16 | 0 | −15 | −35 | −70 |
| 17 | 0 | −10 | −25 | −55 |
| 18 | −20 | −50 | −105 | −355 |
| 19 | 0 | −20 | −45 | −115 |
| 20 | −30 | −45 | −95 | −380 |
| 21 | 0 | −10 | −15 | −55 |
| 22 | 0 | −15 | −25 | −40 |
| 23 | 0 | −25 | −30 | −55 |
| 24 | −10 | −45 | −60 | −250 |
| 25 | 0 | −25 | −70 | −180 |
| 26 | 0 | −30 | −55 | −210 |
| 27 | 0 | −50 | −75 | −255 |

TABLE 3

| T.P. | Observation Results of Sectional Geometry: Test Temperature 900° C. | | Test Temperature 1000° C. | |
|---|---|---|---|---|
| No. | Base Material | Coated Layer | Base Material | Coated Layer |
| 1 | ○ | ○ | ○ | Δ |
| 2 | ○ | ○ | ○ | ○ |
| 3 | ○ | ○ | ○ | ○ |
| 4 | ○ | ○ | ○ | ○ |
| 5 | ○ | Δ | ○ | Δ |
| 6 | ○ | ○ | ○ | ○ |
| 7 | ○ | ○ | ○ | ○ |
| 8 | ○ | ○ | ○ | ○ |
| 9 | ○ | Δ | ○ | Δ |
| 10 | ○ | Δ | Δ | X |

TABLE 3-continued

| T.P. | Observation Results of Sectional Geometry: Test Temperature 900° C. | | Test Temperature 1000° C. | |
|---|---|---|---|---|
| No. | Base Material | Coated Layer | Base Material | Coated Layer |
| 11 | ○ | Δ | ○ | X |
| 12 | ○ | X | Δ | X |
| 13 | ○ | Δ | ○ | Δ |
| 14 | ○ | Δ | Δ | X |
| 15 | ○ | Δ | ○ | X |
| 16 | ○ | Δ | ○ | X |
| 17 | ○ | Δ | ○ | X |
| 18 | ○ | X | Δ | X |
| 19 | ○ | Δ | ○ | Δ |
| 20 | Δ | X | Δ | X |
| 21 | ○ | ○ | ○ | Δ |
| 22 | ○ | Δ | ○ | Δ |
| 23 | ○ | Δ | ○ | Δ |
| 24 | ○ | Δ | Δ | X |
| 25 | ○ | Δ | ○ | X |
| 26 | ○ | Δ | Δ | X |
| 27 | ○ | Δ | Δ | X |

○ Normal
Δ Partial Damage
X Entire Damage

From the test results of the coated layers of the present invention (Table 1) and the known coated layers (Tables 2 and 3), there absolutely no reduction in weight in the coated layers (No.2–No.4) of the present invention and in the known coated layers of Nos. 6–8, and the sectional geometries are normal. On the other hand, in the case of providing the Al diffused layer on the CoCrAlY alloy-coated layer shown by Nos. 25–27, the anticorrosive property thereof is bad enough to cause the high-temperature corrosion even in a part of the base material in the high-temperature test. Further, in the case of Nos. 1 and 5, the Al concentration in the Al diffused layer is not optimal, and hence the anticorrosive property at the high temperature is lower than in the coated layer of the present invention. In each of other coated layers of Nos. 9–24, the weight is reduced in the high-temperature test of 900° C. or above, and the sectional geometry is damaged, which are conspicuous especially at 1000° C.

However, in a Co based MCrAlY alloy containing 10–30% Cr and 5–15% Al and a CoNiCrAlY alloy containing 10–30% CR and 5–15% Al and having a Co/Ni ratio of 0.5 or larger, the anticorrosive property sat 900° C. is superior to MCrAlY alloys of other elements. Therefore, in accordance with the embodiment of the present invention, the lower coated layer involves the use of the alloy of CO-32% Ni-21% Cr-8% Al-0.5% Y. However, the same anticorrosive property as that of this embodiment can be obtained even by using alloys of CoCrAlY and CoNiCrAly which fall within the above-mentioned composition range as the lower coated layer according to the present invention. Besides, the upper coated layer involves the use of the NiCrAlY alloy falling within the composition range described above. The same anticorrosive property as that of this embodiment can be thereby acquired. This kind of evaluation method simulates the high-temperature corrosion to which an actual gas turbine blade is subjected. Influences by thermal stress caused by a start and stop of the gas turbine are not, however, targeted.

Figure 4:
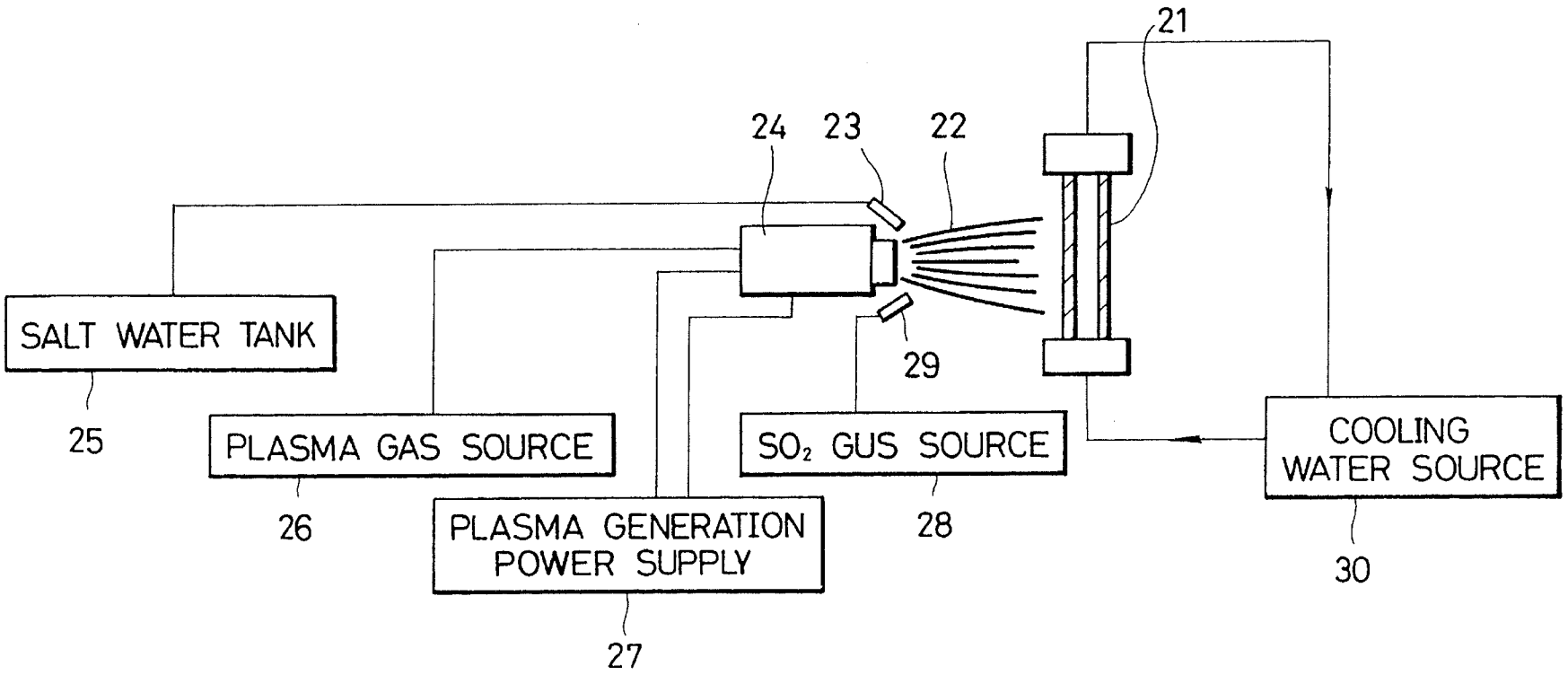
FIG. 4 is a schematic view depicting a testing device wherein the high-temperature corrosion and thermal stress synergize.

Then, according to the present invention, the evaluation is performed in simulation to the actual environment of the gas turbine blade in which the thermal stress and the high-temperature corrosion synergize by use of the testing device illustrated in FIG. 4. Based on the present method, a plasma jet of Ar-7% $H_2$ gas is used as a heating source, and an interior of the hollowed test specimen is cooled off by the compressed air. An output of the plasma jet is on the order of 40 KW, and a heating distance is 100 mm. $SO_2$ gas and NaCl are added into the plasma jet. Further, a cyclic test is effected, wherein heating by the plasma jet is repeated at 10 min., and a cooling step of performing only cooling by moving a plasma gun for generating the plasma jet is repeated at 1 min.

As a consequence of this, $Na_2SO_4$ fused salt is formed on one surface of the test specimen due to $SO_2$ gas and NaCl. The conditions become high-temperature corrosion conditions in which the actual conditions are promoted. Simultaneously, the conditions become thermal conditions of the gas turbine blade (heat flux: 1 $MW/m^2$, heating-time base material temperature: 950° C., cooling-time base material temperature: 250° C.) and also thermal stress conditions to simulate the start and stop of the gas turbine with heating and cooling repetitions.

In such a test, the evaluation is performed by use of the respective test specimens provided with the coated layers (Nos. 2–4) of the present invention shown in Table 1 and the known coated layers of Nos.6–8, 11, 21. The cycle number of the test is 1500. Table 4 shows the results of observing both appearances and sectional geometries after the test.

TABLE 4

| | | Observation Results of Sectional Geometry | | |
|---|---|---|---|---|
| T.P. No. | Weight Variation ($mg/cm^2$) | Base Material | Lower Coated Layer | Upper Coated Layer |
| 2 | −3 | No damage | No damage | Cracks Partially damaged at crack tips |
| 3 | −5 | No damage | No damage | Cracks Partially damaged at crack tips |
| 4 | −3 | No damage | No damage | Cracks Partially damaged at crack tips |
| 6 | −120 | Partially damaged | — | Cracks Partially damaged at crack tips |
| 7 | −150 | Partially damaged | — | Cracks Partially damaged at crack tips |
| 8 | −120 | Partially damaged | — | Cracks Partially damaged at crack tips |
| 11 | −350 | Partially damaged | — | Damaged |
| 21 | −160 | Partially damaged | — | Damaged |

No damage due to the high-temperature corrosion can be seen when observing the appearances of the coated layers (Nos. 2–4) of the present invention. As a result of observing the sectional geometries, a multiplicity of thicknesswise cracks are caused in the surface of the surface layer part, having a large Al content, of the NiCrAlY alloy-coated layer. A damage ($Cr_2O_3$ and $Al_2O_3$ are seen ion the damaged portion as a result of EPMA) derived from the high-temperature corrosion is recognized in the crack tip part of the NiCrAlY alloy-coated layer. No damage attributed to the high-temperature corrosion is, however, recognized in the lower layer, i.e., CoNiCrAlY alloy-coated layer. The layer is normal, and, as a matter of course, there is no damage to the base material.

On the other hand, there are caused the cracks in the NiCrAlY alloy-coated layers in which the Al contents of the surface parts of Nos. 6–8 are increased. The crack tip portions thereof are damaged due to the high-temperature corrosion. Then, the damage partially reaches the base material. $Cr_2O_3$, $Al_2O_3$ and NiS are recognized in the damaged portion of the base material as a result of EPMA. Further, in the coated layers of Nos. 11 and 21, there can be seen almost no occurrence of the cracks. However, the damages derived from the high-temperature corrosion are recognized towards an interior from the surface portion. The damage reaches even a boundary with the base material. A damage to the base material is partially recognized.

As a result of the evaluation test described above, it becomes apparent that the coated layers of the present invention exhibit a more excellent reliability than the conventional coated layers even under a severe environment wherein the thermal stress field and the high temperature synergize in simulation to the gas turbine blade.

Figure 5:
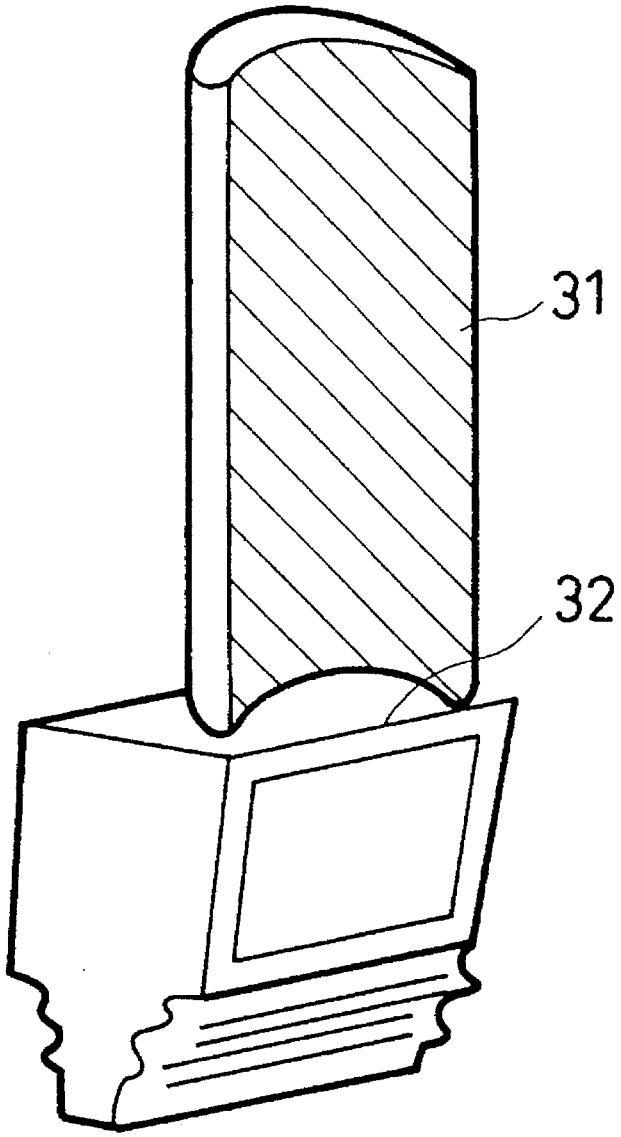
FIG. 5 is a perspective view illustrating an alloy-coated gas turbine blade according to the present invention.

Next, the gas turbine blade according to the present invention is manufactured. FIG. 5 is a view illustrating an appearance of the gas turbine blade. A cooling path for air cooling is formed in an interior of the gas turbine blade including pin fins and a turbulence promoter for increasing a cooling efficiency. The blade is small in wall thickness and takes a hollowed structure. The blade base material is composed of the Ni-radical heat resistant alloy (René-80 make). The coated layers of the present invention are formed of the same material and by the same method as those described above. The coated layers of the present invention are provided on a blade surface 31 and a platform 32 exposed to a high-temperature combustion gas. As a consequence of employing this type of gas turbine blade as an actual gas turbine moving blade, a durability against the high-temperature corrosion is three or four times as large as that provided with the conventional coated layer of No.1 or No.21 in Table 1.

Embodiment 2

Coated layer based on a double layer laminated structure and composed of CoNiCrAlY and NiCrAlY are formed on the surface of a base material, wherein the test specimen base material for use and the method to be employed are the same as those in the embodiment 1. The conditions thereof are absolutely the same as those in the embodiment 1. Effected thereafter is a treatment to increase the Al content of the surface portion of the NiCrAlY alloy-coated layer. The treating method is the same as that in the embodiment 1. However, the heating treatment is performed for 4 hours in the Ar atmosphere of 800° C. Thereafter, the test specimen is taken out of the mixed powder, and substances adhered to the surface are removed. The heating treatment is then performed for 4 hours at 1060° C. in vacuum.

Figure 6A:
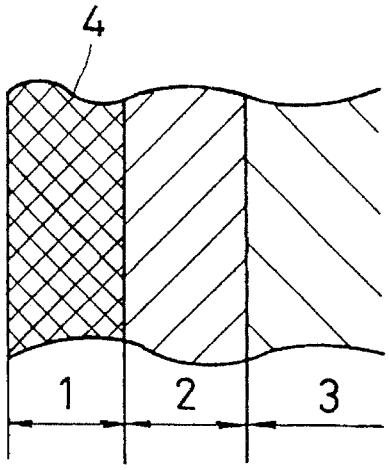
FIG. 6A is a schematic sectional view showing the coated layer according to the present invention.
Figure 6B:
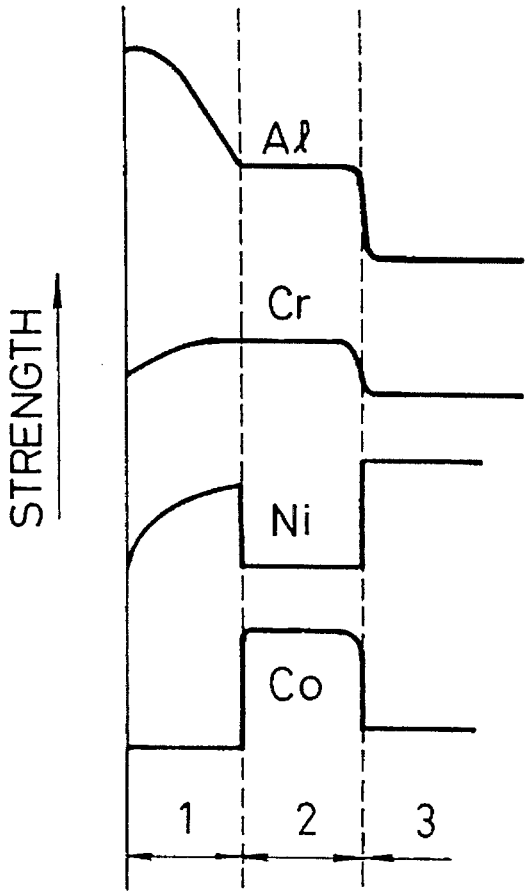
FIG. 6B is a view showing analytic results of Co, Ni, Cr, Al by EPMA.

FIGS. 6A and 6B are a schematic view showing a result of observing the sectional geometry of the thus manufactured test specimen and a view showing an analytic result of Co, Ni, Cr, Al in section by EPMA. In the coated layer of the present invention in this instance, the entire NiCrAlY alloy-coated layer is where the Al content of the surface portion of the coated layer increases. The Al content of the surface is largest and reduced towards a more internal part. In this case, the maximum Al concentration in the upper coated layer after effecting an Al diffusion treatment in the Ar atmosphere is 18%. The maximum Al concentration after performing the above-described heating treatment in vacuum is 15%. The same effects as those in the embodiment 1 are obtained from such a coated layer of the present invention as a result of the same test as that shown in FIG.

4, wherein the high-temperature corrosion and the thermal stress synergize. The coated layer exhibits an excellent durability under the conditions where the actual gas turbine blade are simulated.

Embodiment 3

A coated layer of the present invention is manufactured by the same method as that in the embodiment 1, wherein the test specimen base material involves the use of a unidirectional coagulation material (Mar-M247: Ni- 8.4 wt % Cr-0.5 wt % Mo-9.5 wt % W-5.5 wt % Al-0.7 wt % Ti- 3.2 wt % Ta-10.1 wt % Co-1.5 wt % Hf) and a monocrystal material (CMSX-4: Ni-6.6 wt % Cr-0.6 wt % Mo-6.4 wt % W-3 wt % Re-5.6 wt % Al-1.0 wt % Ti-6.5 wt % Ta-9.6 wt % Co-0.1 wt % Hf). The durability of the thus manufactured coated layer of the present invention is evaluated by the testing device of FIG. 4 in the embodiment 1, wherein the high-temperature corrosion and the thermal stress synergize. As a result of this, the same durability as that of the coated layer of the present invention in the embodiment 1 is exhibited in such a case that any material is used as a test specimen base material.

Embodiment 4

The gas turbine blade is manufactured by the same material in-the same configuration as those shown in FIG. 5. The following is a method of forming the coated layer. At the first onset, an alloy-coated layer of Co-32% Ni- 21% Cr-8% Al-0.5% Y is formed to have a thickness of 75 m on only the flank of the blade surface of the gas turbine blade. Thereafter, an alloy-coated layer of Ni-20% Cr-8% Al-0.5% Y is formed to have a thickness of 75 m on the platform exposed to the combustion gas as well as on the entire blade surface including the flank of the blade surface. Effected hereafter is a treatment to increase the Al content of the surface portion of the alloy-coated layer on the entire blade surface and the platform as well. Further, the heating treatment is thereafter executed at 1060° C. for 4 hours in vacuum. A series of these treatment conditions are the same as those in the embodiment 1.

In accordance with this embodiment, the coated layer of the present invention is formed on only the flank surface of the gas turbine blade. The gas turbine blade provided with such a surface coated layer improves the durability of the flank surface of the blade. In the gas turbine blade, this arrangement is effective in such a case that a more intensive high-temperature corrosion and thermal stress are exerted on the flank surface rather than the rear surface of the blade. Similarly to the embodiment 1, as a consequence of using the blade as an actual gas turbine moving blade, the durability against the high-temperature corrosion of the blade flank is 3–4 times as large as that provided with the conventional coated layer of No.1 or No.6 in Table 1.

Embodiment 5

The gas turbine blade is manufactured by the same material in the same configuration as those shown in FIG. 5. The following is a method of forming the coated layer. At the first onset, an alloy-coated layer of Co-32% Ni-21% Cr-8% Al-0.5% Y is formed to have a thickness of 150 m on the blade rear side of the gas turbine. The alloy-coated layer having the same elements is formed up to 75 m on the blade flank side. An alloy-coated layer of Ni-20% Cr-8% Al-0.5% Y is further formed on the blade flank. Note that the alloy-coated layer of Co-32% Ni-21% Cr-8% Al-0.5% Y is formed up to 100 m on the platform. The method and conditions for forming these various coated layers are the same as those in the embodiment 1. Thereafter, the Al diffusion treatment is effected on only the blade flank surface. Note that the method and conditions therefor are the same as those in the embodiment 1. In this case, before performing the Al diffusion treatment, $Al_2O_3$ containing an organic binder is applied on the blade rear surface and the platform. These portions undergoes masking so as not to cause the Al diffusion. After the Al diffusion treatment, the masking material is removed by a honing treatment (honing agent: $Al_2O_3$, particle diameter: 50–200 m, air pressure: 3 $Kg/cm^2$). Performed thereafter is the same vacuum heating treatment as that in the embodiment 1.

In the gas turbine blade of this embodiment, this arrangement is effective in such a case that a more intensive high-temperature corrosion and thermal stress are exerted on the blade flank. Similarly to the embodiment 1, as a consequence of employing the turbine as an actual gas turbine moving blade, the durability of the blade flank against the high-temperature corrosion is 3–4 times as large as that provided with the conventional coated layer.

Embodiment 6

Figure 7:
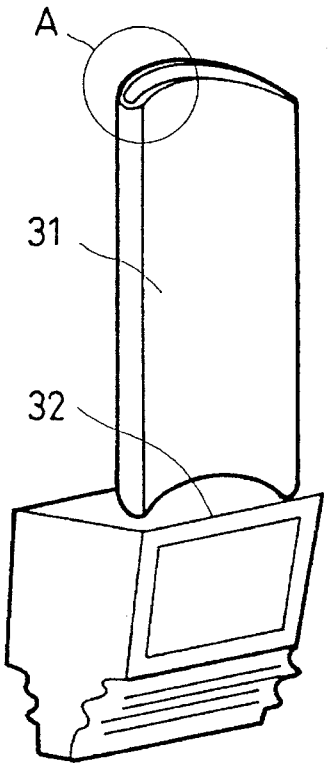
FIG. 7 is a perspective view illustrating an alloy-coated gas turbine b lade according to the present invention.
Figure 8:
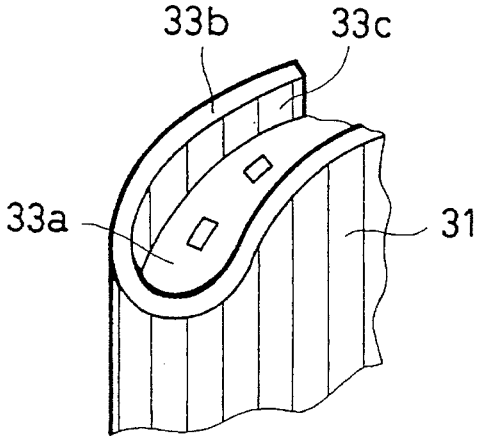
FIG. 8 is a perspective view of the principal portion.

The gas turbine blade of the present invention is manufactured by use of the gas turbine blade (Rene'-80 make) assuming the configuration shown in FIGS. 7 and 8. As a method of forming the coated layers, the coated layers based on a CoNiCrAlY/NiCrAlY double layer laminated structure are formed on the surface of the platform 32 exposed to the combustion gas as well as on the entire blade surface 31 shown in FIG. 7, wherein the coating material, the method and the conditions are the same as those in the embodiment 1. Increased thereafter by the same method as that in the embodiment 1 are the Al contents in the vicinity of the surfaces of the coated layers with respect to the front surface of the blade surface 31 and the surface of the platform 32. Augmented simultaneously are the Al contents of the respective portions on the base material surfaces of blade tip parts 33*a*, 33*b*, 33*c* shown in FIG. 8.

As a result, the gas turbine blade according to the present invention can be manufactured, this blade being arranged to form the alloy-coated layers on the blade tip parts 33*a*, 33*b*, 33*c* shown in FIG. 8 that are hard to form the alloy-coated layers, admit a flow of cooling gas and have the base material temperatures lower than other parts while increasing the Al content in the vicinity of the surface of the Ni-radical superalloy and to form the layers on the platform 32 and the blade front surface 31 having the high base material temperature while increasing the Al content of the surface. In the gas turbine blade of this invention, when used as an actual blade, the high-temperature corrosion from the blade tip parts can be prevented, and an excellent high-temperature durability is exhibited.

Embodiment 7

Figure 9:
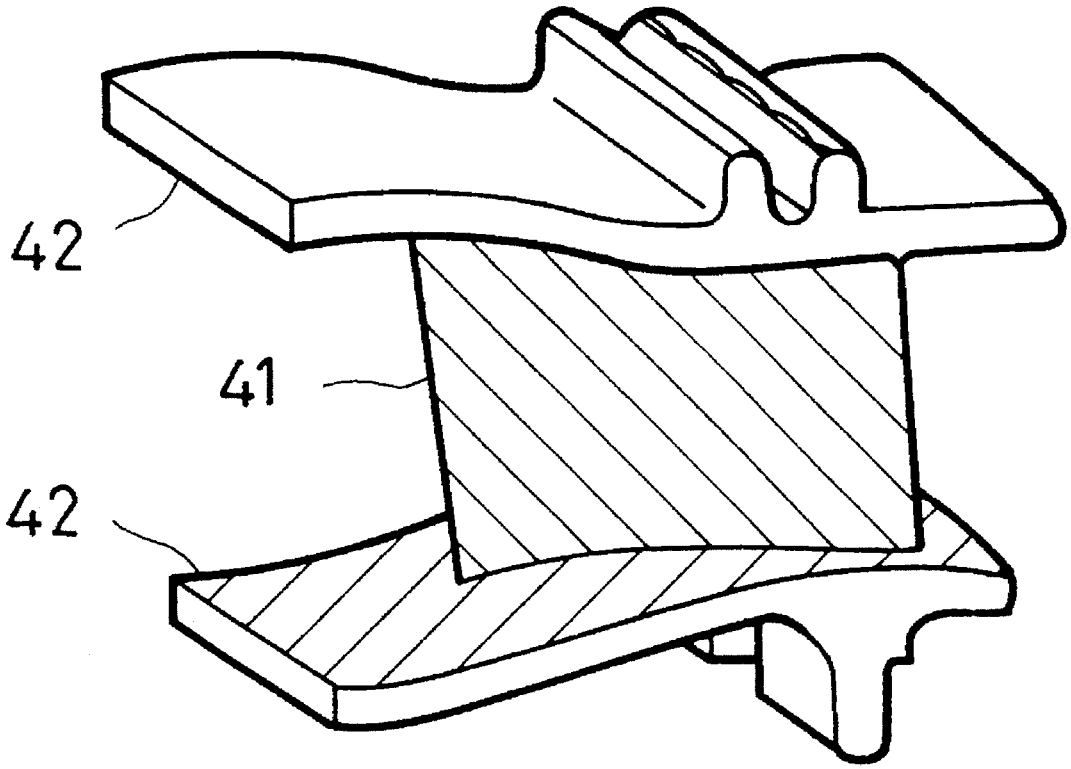
FIG. 9 is a perspective view illustrating an alloy-coated gas turbine stationary blade according to the present invention.

The gas turbine blade of the present invention is manufactured by use of a turbine blade (IN-939 make, elements: 19.5% Co-22.5% Cr-2.0% Al-2.0% W-1.0% Nb-1.4% Ta-3.7% Ti-0.1% Zr-0.15% C-remaining Ni) assuming a configuration illustrated in FIG. 9. Manufactured is the gas turbine blade arranged such that the coated layers of this invention are formed, as shown in FIG. 9, on an entire blade surface 41 and a gas-pass portion 42 exposed to the combustion gas, wherein the coating material, the method and the conditions are the same as those in the embodiment 1.

As a consequence of employing the blade as an actual turbine blade similarly to the embodiment 1, the durability of this gas turbine blade against the high-temperature corrosion is 3–4 times as large as that provided with the conventional coated layer of No. 8 or No.21 in Table 1. Besides, in the turbine blade (IN-939 make) assuming the configuration illustrated in FIG. 9, there is manufactured the gas turbine blade formed with the coated layers of this invention by the same method as that in the embodiment 4 or 5. As a result of using these gas turbine blades of the present invention as actual gas turbine blades, the same superlative high-temperature durability as the above-mentioned is obtained.

Embodiment 8

Figure 10:
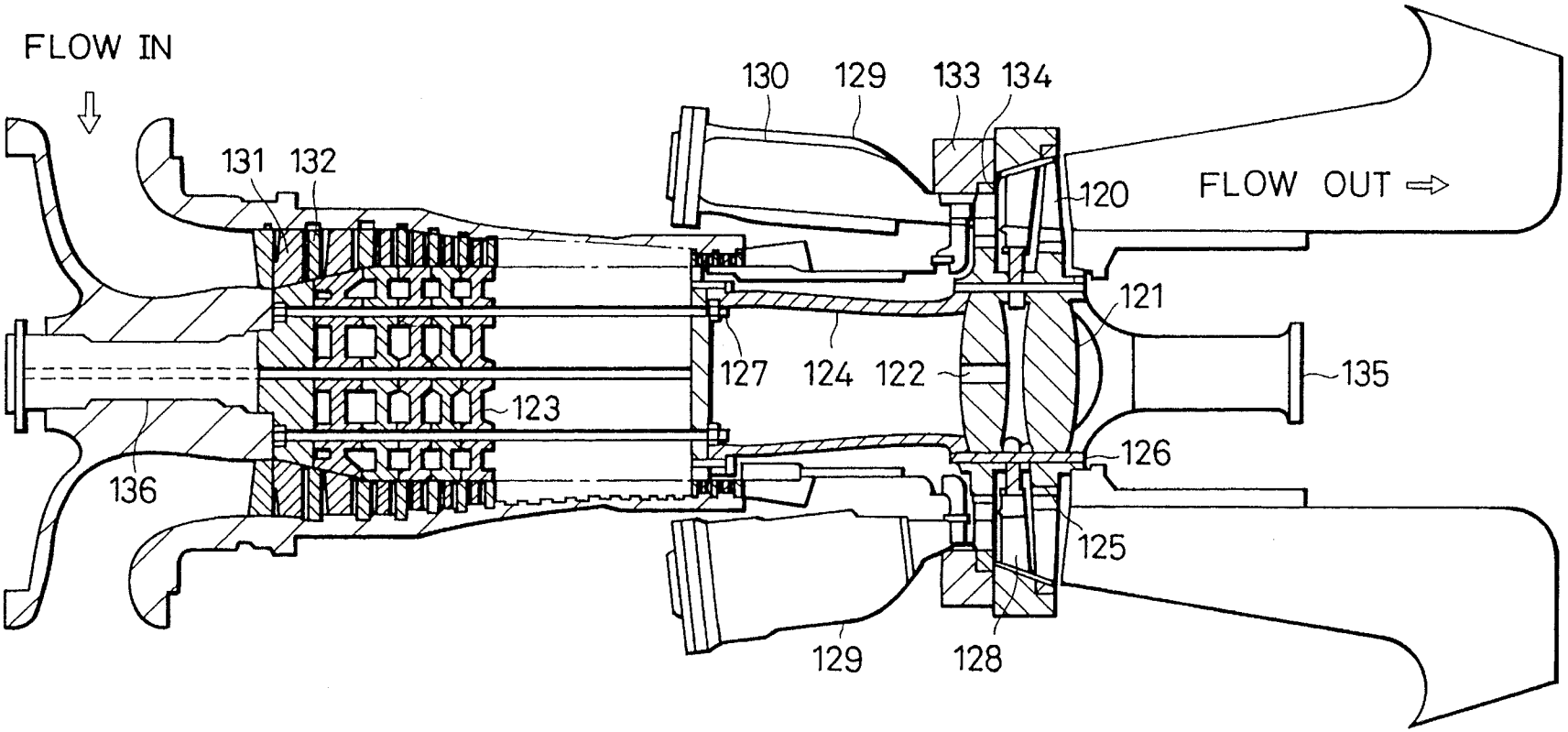
FIG. 10 is a sectional view showing a gas turbine according to the present invention.

FIG. 10 is a partial sectional view showing a rotary portion of the gas turbine according to the present invention. Central holes 122 are formed at the first and second stages from the upstream side of a gas flow in a 2-staged turbine disk 121 of this embodiment. Further, in accordance with this embodiment, 12% Cr all martensite system heat resistant steel is employed for the final stage of a compressor disk 123 on the downstream side of the gas flow, a distance piece 124, a turbine spacer 125, a turbine stacking bolt 126 and a compressor stacking bolt 127. Provided additionally at the second stage are a turbine blade 120, a turbine nozzle 128, a liner 130 of a combustor 129, a compressor blade 131, a compressor nozzle 132, a diaphragm 133 and a shroud 134. The numeral 135 designates a turbine stub shaft, and 136 represents a compressor stub shaft. The coated layer according to the present invention are formed on the turbine blade 120 and the turbine nozzle 128, whereby a gas turbine system for a high efficiency power generation is attainable.

As discussed above, the coated layer of this invention contribute largely to an improvement of the durability and a long life-time of the gas turbine blade used under such an environment that the high-temperature corrosion and the thermal stress synergize. Especially in the gas turbine having a high power generation efficiency, the combustion gas temperature goes up. It is consequently essential that to cool off the blade to adjust the temperature of the blade base material to the heat resistant temperature of the heat resistant alloy. Hence, the hollowed and thin blade structure is adopted, and the wall-reduction of the base material due to the high-temperature corrosion effects a rate-determination about the life-time of the blade. Further, in the thus structured blade, the thermal stress concomitant with the start and stop of the gas turbine increases. In the coated layers of the present invention, however, the high-temperature resistance to corrosion can be kept owing to the lower coated layer even when the cracks are caused in the coated layers due to the thermal stress. The gas turbine system for the high efficiency power generation is attainable by using the gas turbine blade of the present invention in terms of the above-described points.

Although the illustrative embodiments of the present invention have been described in detail with reference to the accompanying drawings, it is to be understood that the present invention si not limited to those embodiments. Various changes or modifications may be effected by one skilled in the art without departing from the scope or spirit of the invention.

What is claimed is:

1. A gas turbine blade having a coated layer provided on the surface of a base material made of a heat resistant alloy and exhibiting an opulent high-temperature anticorrosive property and oxidation resistant property, said coated layer comprising two layers, one layer being a Co based lower alloy-coated layer containing Cr, Al and Y and provided as a portion which contacts said base material, and the other layer being a Ni based upper alloy-coated layer containing Cr, Al and Y and provided on the lower alloy-coated layer, wherein said lower alloy-coated layer consists of 10–30 wt % Cr, 5–15 wt % Al, 0.1–1.5 wt % Y, remaining Co and inevitable impurities, and said upper alloy-coated layer consists of 10–30 wt % Cr, 5–25 wt % Al, 0.1–1.5 wt % Y, remaining Ni and the inevitable impurities, wherein the Al content of said upper alloy-coated layer is, in part, diffused into the upper layer to exhibit a maximum Al concentration at the outermost surface of said upper layer and the Al concentration is continuously reduced at most up to the innermost surface of said upper layer, wherein the maximum concentration of Al in the upper alloy-coated layer is 15–25% by weight and minimum concentration of Al in the upper layer is 5–15 wt % and is less than the maximum concentration.

2. An alloy-coated gas turbine blade of claim 1, wherein Al diffused in said upper alloy-coated layer is reduced continuously from the outermost surface to a portion of said upper alloy-coated layer which contacts said lower alloy-coated layer.

3. An alloy-coated gas turbine blade of claim 1, wherein Al diffused in said upper alloy-coated layer is reduced continuously from the outermost surface and comes to a substantially constant value at a portion on the upper alloy-coated layer side just before contacting said lower alloy-coated layer.

4. An alloy-coated gas turbine blade of claim 1, wherein said lower alloy-coated layer is 25–200 μm thick, and said upper alloy-coated layer is 25–200 μm thick.

5. An alloy-coated gas turbine blade of claim 1, wherein said lower alloy-coated layer and said upper alloy-coated layer into which Al is diffused are provided on at least an entire blade surface and a platform.

6. An alloy-coated gas turbine blade of claim 1, wherein said upper alloy-coated layer into which Al is diffused and said lower alloy-coated layer are provided on at least said entire blade surface and the surface of a gas-pass portion exposed to a combustion gas.

7. A gas turbine comprising:

a compressor;

a combustor; and any one of a single-staged and plural-staged turbine blade in which a dovetail portion is fixed to a turbine disk, characterized by further comprising said alloy-coated gas turbine blade claimed in claim 1.

8. A gas turbine blade having a coated layer provided on the surface of a base material made of a heat resistant alloy and exhibiting an opulent high-temperature anticorrosive property and oxidation resistant property, said coated layer comprising two layers, one layer being a Co—Ni based lower alloy-coated layer containing Cr, Al and Y, and provided as a portion which contacts said base material, and the other layer being a Ni based upper alloy-coated layer containing Cr, Al and Y, and provided on the lower alloy-coated layer, wherein said lower alloy-coated layer consists of 10–30 wt % Cr, 5–15 wt % Al, 0.1–1.5 wt % Y, remaining Co—Ni, the Co/Ni ratio of which is at least 0.5 and inevitable impurities, and said upper alloy-coated layer consists of 10–30 wt % Cr, 5–25 wt % Al, 0.1–1.5 wt % Y, remaining Ni and the inevitable impurities, wherein the Al content of said upper alloy-coated layer is, in part, diffused into the upper layer to exhibit a maximum Al concentration at the outermost surface of said upper layer and the Al concentration is continuously reduced at most up to the innermost surface of said upper layer, wherein the maximum concentration of Al in the upper alloy-coated layer is 15–25 wt % and minimum concentration of Al in the upper layer is 5–15 wt % and is less than the maximum concentration.

9. An alloy-coated gas turbine blade of claim 8, wherein Al diffused in said upper alloy-coated layer is reduced continuously from the outermost surface to a portion of said upper alloy-coated layer which contacts said lower alloy-coated layer.

10. An alloy-coated gas turbine blade of claim 8, wherein Al diffused in said upper alloy-coated layer is reduced gradually from the outermost surface and comes to a substantially constant value at a portion on the upper alloy-coated layer side just before contacting said lower alloy-coated layer.

11. An alloy-coated gas turbine blade of claim 8, wherein said lower alloy-coated layer is 25–200 μm thick, and said upper alloy-coated layer is 25–200 μm thick.

12. An alloy-coated gas turbine blade of claim 8, wherein said upper alloy-coated layer into which Al is diffused and said lower alloy-coated layer are provided on at least said entire blade surface and a platform.

13. An alloy-coated gas turbine blade of claim 8, wherein said upper alloy-coated layer into which Al is diffused and said lower alloy-coated layer are provided on at least said entire blade surface and the surface of a gas-pass portion exposed to a combustion gas.

14. A gas turbine comprising:

a compressor;

a combustor; and any one of a single-staged and plural-staged turbine blade in which a dovetail portion is fixed to a turbine disk, characterized by further comprising said alloy-coated gas turbine blade claimed in claim 8.

15. A method of manufacturing an alloy-coated gas turbine blade having a coated layer provided on the surface of a base material made of a heat resistant alloy and exhibiting an opulent high-temperature anticorrosive property and oxidation resistant property, said method comprising the steps of:

forming, on the base material surface, a lower alloy-coated layer a principal element of which is any one of Co and Co—Ni alloy, said lower alloy-coated layer containing Cr, Al and Y, wherein said lower alloy-coated layer consists of 10–30 wt % Cr, 5–15 wt % Al, 0.1–1.5 wt % Y, remaining Co or Co—Ni alloy in which the Co/Ni ratio is at least 0.5 and inevitable impurities, forming a Ni based upper alloy-coated layer containing Cr, Al and Y on the surface of said lower alloy-coated layer, wherein said upper alloy-coated layer consists of 10–30 wt % Cr, 5–15 wt % Al, 0.1–1.5 wt % Y, remaining Ni and the inevitable impurities;

permeating Al diffusively into said upper alloy-coated layer, wherein a maximum concentration of Al in the Al diffused upper alloy-coated layer is 15–25 wt %.

* * * * *